US006813791B2

(12) United States Patent
Mossbeck et al.

(10) Patent No.: US 6,813,791 B2
(45) Date of Patent: Nov. 9, 2004

(54) POSTURIZED POCKETED BEDDING OR SEATING PRODUCT HAVING POCKETS OF DIFFERING HEIGHTS

(75) Inventors: Niels S. Mossbeck, Carthage, MO (US); Thomas J. Wells, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/379,045

(22) Filed: Mar. 4, 2003

(65) Prior Publication Data

US 2004/0172767 A1 Sep. 9, 2004

(51) Int. Cl.[7] ..... A47C 27/04
(52) U.S. Cl. ..... 5/720; 5/716; 5/719; 5/727
(58) Field of Search ..... 5/716, 717, 719, 5/720, 727, 730, 739

(56) References Cited

U.S. PATENT DOCUMENTS

| | | | | |
|---|---|---|---|---|
| 1,682,394 A | * | 8/1928 | Meutsch | 5/720 |
| 2,742,957 A | | 4/1956 | Young | |
| 4,439,977 A | | 4/1984 | Stumpf | |
| 5,724,686 A | | 3/1998 | Neal | |
| 6,101,697 A | | 8/2000 | Stumpf et al. | |
| 6,122,787 A | * | 9/2000 | Kao | 5/723 |
| 6,143,122 A | | 11/2000 | Mossbeck et al. | |
| 6,154,908 A | * | 12/2000 | Wells | 5/720 |
| 6,170,807 B1 | | 1/2001 | Eto | |
| 6,173,464 B1 | | 1/2001 | McCune et al. | |
| 6,353,952 B1 | * | 3/2002 | Wells | 5/716 |
| 6,397,418 B1 | | 6/2002 | Stjerna | |
| 6,398,199 B1 | | 6/2002 | Barber | |
| 6,490,744 B1 | * | 12/2002 | Schulz, Jr. | 5/720 |
| 6,540,214 B2 | | 4/2003 | Barber | |
| 6,658,682 B1 | * | 12/2003 | Wells | 5/655.7 |

FOREIGN PATENT DOCUMENTS

| | | |
|---|---|---|
| WO | WO 94/18116 | 2/1994 |
| WO | WO 2004/039215 | 5/2004 |

OTHER PUBLICATIONS

U.S. patent application Publication No. 2003/O074736, *Innerspring Assembly,* Grothaus.

U.S. patent application Publication No. US 2003/0218285, *Innerspring Assembly and Method of Making an Inner Spring Assembly,* Grothaus.

* cited by examiner

*Primary Examiner*—Michael F. Trettel
(74) *Attorney, Agent, or Firm*—Wood, Herron & Evans, L.L.P.

(57) ABSTRACT

A bedding or seating product comprising a pocketed spring assembly made up of a plurality of parallel strings of springs joined to each other. Each of the strings of springs comprises a plurality of interconnected pocketed coil springs. The product has multiple sections of differing firmness attributable in part to differing heights of the pockets of the strings of springs. Filler is placed above the lower sections of the pocketed spring assembly.

20 Claims, 11 Drawing Sheets

POSTURIZED POCKETED BEDDING OR SEATING PRODUCT HAVING POCKETS OF DIFFERING HEIGHTS

FIELD OF THE INVENTION

This invention relates generally to pocketed spring assemblies for mattresses, cushions and other bedding or seating products and, more particularly, to a posturized pocketed coil spring assembly and associated method of manufacturing such an assembly.

BACKGROUND OF THE INVENTION

A well known type of bedding or seating product comprises a spring assembly which includes a number of discrete coil springs, each of which is enclosed in a fabric pocket in a length of folded fabric material. Longitudinal axes of the coil springs are generally parallel with one another so that the top and bottom end turns of the coil springs define top and bottom faces of the spring assembly. A row of such pocketed springs is known in the industry as a string of pocketed springs. A bedding or seating product can be fabricated from such strings of pocketed springs by binding or adhering the individual rows or strings of pocketed springs together to form a spring assembly which may be padded and encased in an upholstered covering. U.S. Pat. No. 6,143,122, which is fully incorporated herein, discloses one such method of adhesively bonding strings of pocketed springs together to form a spring assembly.

This type of spring assembly is commonly referred to as a pocketed spring assembly due to the fact that each spring is contained within an individual pocket of fabric material. The construction of strings of pocketed coil springs in each pocket is well known in the art and, for example, is disclosed in U.S. Pat. No. 4,439,977 which is hereby incorporated by reference in its entirety. The system disclosed in that patent includes a spring coiler which forms a coil spring which is subsequently compressed and inserted between the plies of folded pocketing fabric material. Other systems for manufacturing pocketed coil spring assemblies are disclosed in PCT Patent Application No. WO 94/18116 and U.S. Pat. No. 6,101,697, each of which are expressly incorporated herein by reference.

Pocketed spring assemblies are generally recognized to have a unique and particular luxurious feel to them and mattresses manufactured of such pocketed spring assemblies provide a feeling of softness without lacking spring resilience or support. Mattresses and similar articles constructed of pocketed spring assemblies are often considered a high-end type of product because of the added benefits and features of the pocketed coil springs. Mattresses and the like of this type can be more costly to manufacture and assemble as a result of the considerable amount of time and labor which is involved in their manufacture, together with the fact that the method of fabrication and assembly of such pocketed spring assemblies can be complicated, particularly in an automated process.

One particular aspect of pocketed spring assemblies and the associated mattresses or the like is that the resulting product may have a "hard" feel due to the fact that all of the coil springs are identical and compressed to the same degree in individual pockets. Usually, the firmness of such a product is uniform across the width and along the length of the product.

Additionally, while pocketed spring assemblies desirably provide a combination of softness and support, the ability to economically posturize a spring assembly or mattress of pocketed spring coils has heretofore been difficult. Posturization provides multiple zones or sections of differing firmnesses within a product such as a mattress. For example, the middle regions of the mattress, which typically support a person's torso, often require a firmer more resilient support while other areas of the mattress which support the feet and head of a person require a softer feel.

One known method of posturizing a pocketed spring unit has been to incorporate springs made of different gauge wire into the strings of springs. For example, the springs incorporated into the strings of springs within certain sections or zones of the spring assembly are made of a larger gauge wire than the springs incorporated into the strings of springs of the other sections or zones of the spring assembly. U.S. Pat. No. 6,173,464 discloses this concept, albeit with continuous bands of springs as opposed to individual springs.

Another method of posturizing a spring assembly made of conventional coil springs, as opposed to pocketed coil springs incorporated into strings of pocketed springs, is to place filler material such as urethane foam on top of the shorter springs of the spring assembly. Applicant's U.S. Pat. No. 6,353,952, incorporated by reference herein, discloses a bedding or seating product made in such a manner. However, this method has heretofore been used only with unpocketed coil springs.

Therefore, there is a need for a posturized pocketed spring assembly and associated method of manufacture which offers the advantages of posturization of the pocketed spring assembly without the higher manufacturing costs, production difficulties and inefficiencies associated with known posturized pocketed spring assemblies.

There is further a need to provide a posturized bedding or seating product utilizing strings of pocketed springs of differing heights so as to impart differing degrees of firmness to different sections of the product.

SUMMARY OF THE INVENTION

The invention of this application comprises a pocketed bedding or seating product and associated method of manufacture. The bedding or seating product comprises a pocketed spring assembly, filler materials, one or more pads and an upholstered covering surrounding the pocketed spring assembly, filler material and pads.

The pocketed spring assembly comprises a plurality of parallel strings of springs joined together. Each of the strings of springs comprises a plurality of interconnected pocketed coil springs. Each of the pocketed coil springs comprises a spring surrounded with a pocket of fabric, as is conventional. The springs are typically coil springs, but may be other types of springs. Each of the coil springs has an upper end turn, a lower end turn and a plurality of central convolutions between the end turns.

Preferably, each string of springs is made of one piece of fabric folded and welded into a plurality of pockets, each of the pockets containing a coil spring. Opposed plies of fabric of the string of springs may be joined together by sewing, gluing or sonic welding, as known in the art. Adjacent pockets within a string of springs are separated by one or more generally vertically oriented lines of attachment or seams of the opposed plies to each other. The height of the pocket is determined by the distance between the bottom of the pocket and one longitudinal segment of attachment or seam of the opposed plies to each other. Alternatively, the height of the pocket may be determined by the distance between top and bottom seams of the pocket.

The bedding or seating product typically has a longitudinal dimension and a transverse dimension, the longitudinal dimension being greater than the transverse dimension. However, the longitudinal dimension and transverse dimension may be identical in a square bedding or seating product. In the invention of the present application, the strings of springs may extend longitudinally or transversely, depending upon the desired effect.

Adjacent strings of springs of the bedding or seating product are preferably glued together but may be otherwise secured to each other. At least one border wire may extend around the perimeter of the pocketed spring assembly of the bedding or seating product and be secured to select outermost pocketed coil springs. A first or lower border wire may be secured to the lower end turns of the coil springs of the outermost strings. A second or upper border wire may be secured to the upper end turns of the coil springs of the outermost strings or, alternatively, either border wire may be secured to intermediate convolutions of the coil springs of the outermost strings of springs.

In each embodiment of the present invention, the bedding or seating product is posturized such that certain regions or portions of the product are firmer than other areas or portions of the product. This may be accomplished by grouping together multiple strings of springs having identical characteristics in one region of a bedding or seating product. The strings of springs of the other regions may have different characteristics so as to impart different firmnesses to the different regions.

In at least one preferred embodiment of the present invention, the pocketed spring assembly has multiple sections or regions of differing firmnesses, each section or region comprising multiple identical strings of springs joined together. In at least one section of the pocketed spring assembly, each string of springs has pockets of an identical first height along its length. In at least one other section of the pocketed spring assembly, each string of springs has pockets of an identical second height along its length. The second height is greater than the first height. For purposes of this application, the strings of springs having pockets of a first height will be considered short strings of springs and the strings of springs having pockets of a second height will be considered tall strings of springs. Filler material is located above the short strings of springs. The filler imparts a softer feel to the user than does the tall strings of springs. Consequently, the sections or regions of the product comprising short strings of springs (those of a first height) and filler above such strings of springs are of a lesser firmness than the firmness of the other sections comprising tall strings of springs (those of a second height). In such embodiments, the strings of springs may extend longitudinally or transversely, depending upon the desired effect.

In several preferred embodiments of the present invention, the filler is of a third height so that when placed upon the springs of a first height, the sum of the first and third heights is approximately equal to the height of the tall strings of springs, i.e., the second height. In such a manner, the bedding or seating product has a uniform upper surface comprising the upper surfaces of the tall strings of springs and the upper surface of the filler.

The filler may be numerous structures and/or materials, including but not limited to pieces of urethane foam, various fibrous materials, air bladders or water bladders or even matrixes of short springs contained in cloth fiber pockets.

In another preferred embodiment the tall strings of springs of a second height extend above and below the short strings of springs of the pocketed spring assembly. In this embodiment, filler is located both above and below the short strings of springs. The upper and lower surfaces of the filler are generally coplanar with upper and lower surfaces of the tall strings of springs, respectively.

In other preferred embodiments of the present invention, strings of springs having pockets of differing heights are incorporated into a pocketed spring assembly. Applicant's U.S. patent application Ser. No. 10/307,883 filed Dec. 2, 2002 entitled "Pocketed Bedding or Seating Product Having Pockets of Alternating Heights", which is fully incorporated by reference herein, discloses such strings of springs incorporated into a pocketed spring assembly. In each of these preferred embodiments, at least several strings of springs have pockets of a first height and pockets of a second height greater than the first height. Filler is located only above the pockets of a first height in accordance with the present invention.

In another preferred embodiment of the present invention, tall pockets of the strings of springs are located in a generally rectangular pattern in the middle of the bedding or seating product, and short pockets of the strings springs (pockets of a lesser height than the pockets in the middle of the product) are arranged around the perimeter of the generally rectangular section of tall pockets. Filler is placed above the short pockets around the perimeter of the bedding or seating product in order to provide a softer feel to the user around the perimeter than in center of this embodiment of product.

In another preferred embodiment of the present invention, a section of short pockets are arranged in a generally rectangular pattern in the middle of the bedding or seating product. Tall pockets (pockets of a greater height than the pockets in the middle section of the product) are arranged around the perimeter of the generally rectangular section of short pockets. Filler is placed above the short pockets in the middle of the bedding or seating product. The tall pockets provide an edge support around the perimeter of the product which is of a greater firmness than the central section or core of the product.

In any of the preferred embodiments of the present invention, the springs may be identical before being inserted into the pockets of the strings of springs. However, once inside the pockets, the springs in the shorter pockets may be compressed more than the springs in the taller pockets. Conversely, the springs may be of different heights before being inserted into the pockets of the strings of springs. Alternatively, the coil springs may have different physical characteristics such as heat treatment, pitch, coil diameter, etc. before being placed in the pockets.

One method of manufacturing the pocketed spring assembly of the present invention comprises inserting at least one spring into each of the pockets of a string of springs. The pockets are then closed such that selected pockets within the string of springs is of a height less than other pockets in the string of springs. The strings of springs are then joined together to form the pocketed spring assembly. Filler is placed above selected pockets of at least some of the strings of springs. The pocketed spring assembly and filler are encased in an upholstered covering.

The method of manufacturing the posturized spring assembly of the present invention varies depending upon the desired posturization. However, in each of the applications of the present invention whenever pockets of differing heights are incorporated into a portion of a string of springs, at least one region or section of the pocketed spring assembly has an initial "soft" feel when a load is placed thereon.

In each of the embodiments of the present invention, incorporating pockets of different heights into at least several strings of springs results in a posturized pocketed spring assembly after multiple strings of springs are joined to each other. Such a product may be made in accordance with a customer's needs and desires quickly and easily.

These and other objects and advantages of the present invention will be more readily apparent from the following drawings.

DETAILED DESCRIPTION OF THE DRAWINGS

Figure 1:
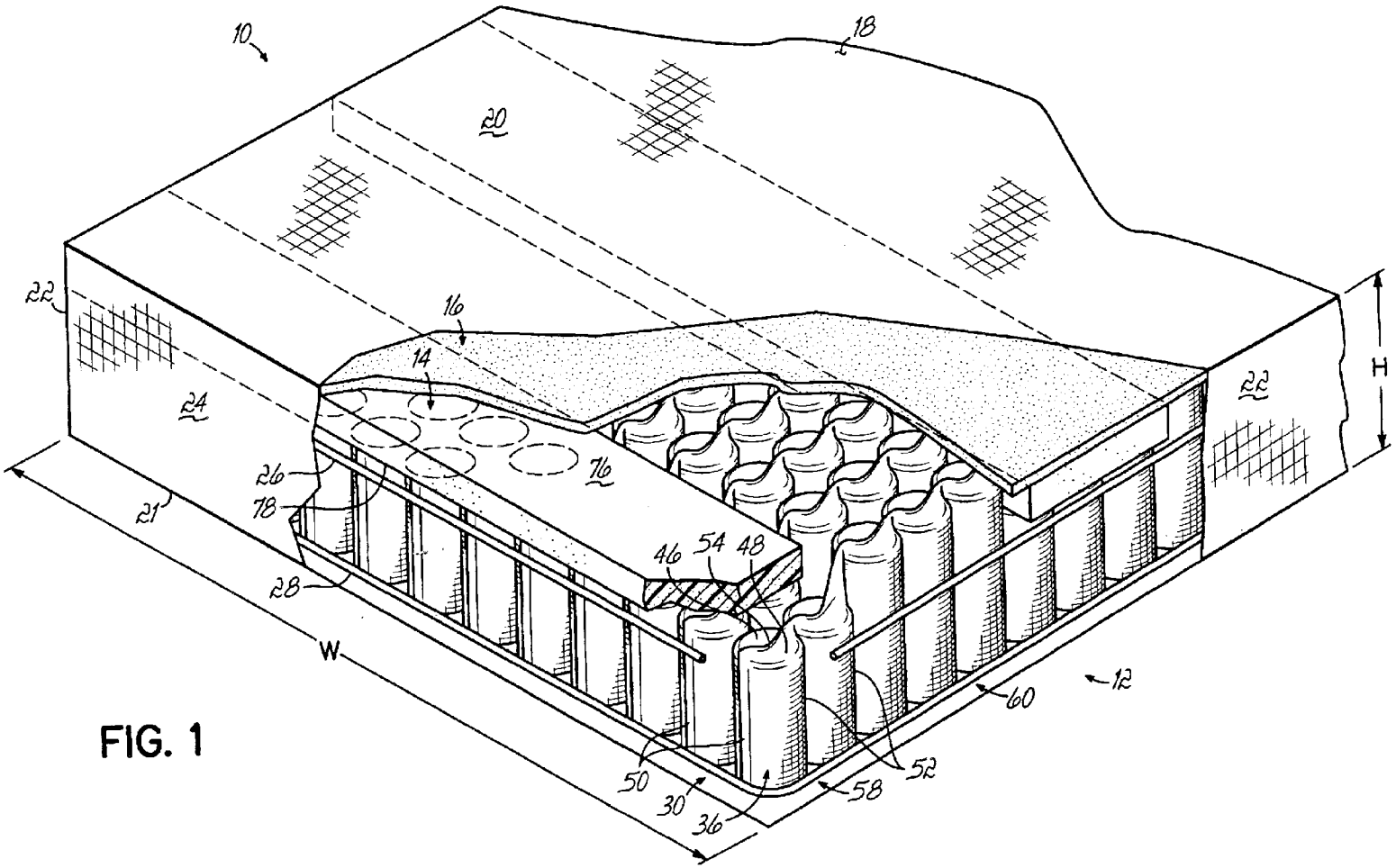
FIG. 1 is a perspective view partially broken away, of a bedding or seating product made in accordance with the present invention.

Referring to the drawings and particularly to FIG. 1 there is illustrated a bedding or seating product 10. The bedding or seating product comprises a pocketed spring assembly 12, filler 14, a layer of padding 16 and an upholstered covering 18. Select pieces of filler 14 rest on top of portions of the pocketed spring assembly 12, the padding 16 overlays the filler 14 and pocketed spring assembly 12, and the upholstered covering 18 surrounds the pocketed spring assembly 12, filler 14 and padding 16. The product 10 has an upper surface 20 and a lower surface 21, the distance between the upper and lower surfaces 20,21 defining a height H of the product 10.

Similarly, the mattress 10 has a transverse dimension or width W defined between opposed side surfaces 22 and a longitudinal dimension or length L defined as the distance between the opposed end surfaces 24 of the mattress 10. See FIG. 1A. The longitudinal dimension is illustrated as being larger than the transverse dimension of the mattress 10 although it is within the contemplation of the present invention that the longitudinal and transverse dimensions be identical, such as in a square product.

If desired, at least one border wire may be secured to the pocketed spring assembly 12 with hog rings or any other conventional fastener 5. FIG. 1 illustrates an upper border wire 26 and a lower border wire 28, both of which are generally rectangular, secured to the pocketed spring assembly 12. However, only one border wire may be used, if desired or none at all.

The pocketed spring assembly 12 comprises a plurality of longitudinally extending strings of springs 30 joined to each other. Adjacent strings of springs are preferably glued together as shown in U.S. Pat. No. 6,143,122, but may be joined to each other using any known technology.

Figure 1A:
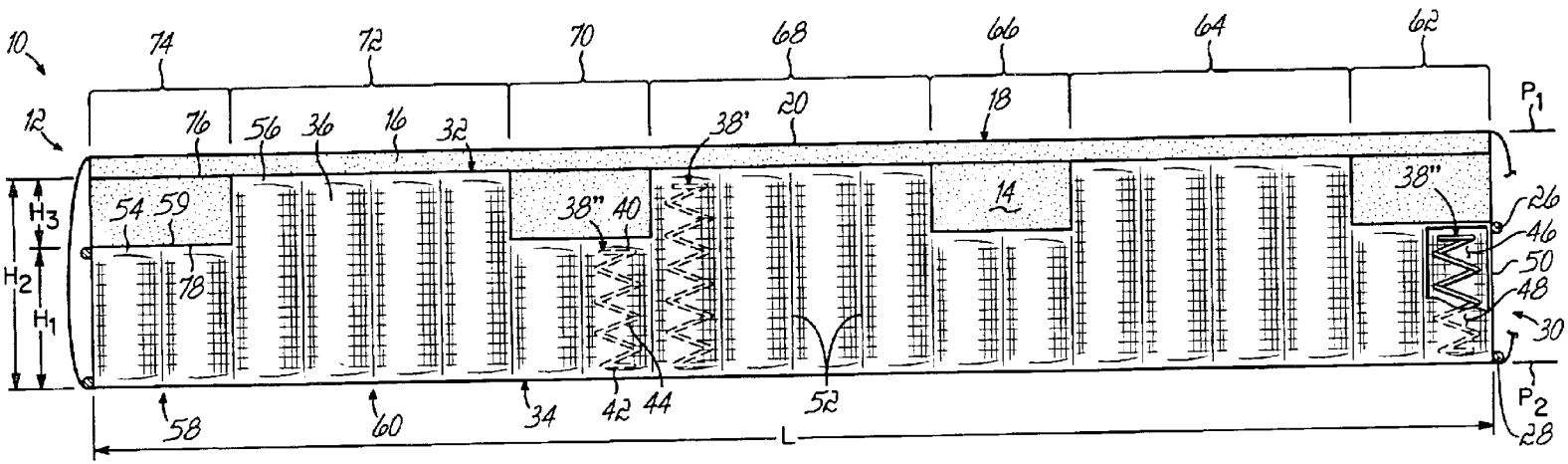
FIG. 1A is a schematic side elevational view of the bedding or seating product illustrated in FIG. 1.

Referring to FIGS. 1 and 1A, each string of springs 30 has a top surface 32 and a bottom surface 34, the distance between which defines the height H2 of the string of springs 30. Each string of springs 30 comprises a plurality of interconnected fabric pockets 36, each fabric pocket 36 containing a coil spring 38. As best illustrated in FIG. 1A, each coil spring 38 has an upper end turn 40, a lower end turn 42 and a plurality of central convolutions 44 between the end turns 40, 42.

Preferably, only one piece of fabric is used to form a string of springs 30, the piece of fabric being folded over onto itself around the aligned coil springs 38 to create a first ply 46 and a second ply 48. As illustrated in FIG. 1A, the first ply 46 is behind the second ply 48. As is known in the art, opposite sides or plies of the fabric are sewn, welded or otherwise secured together in order to create a pair of outermost seams 50, a plurality of internal seams 52 and a plurality of longitudinal seams or segments 54 and 56. The internal seams 52 separate adjacent pockets 36 and therefore adjacent coil springs 38. Although the seams 50, 52, 54 and 56 are illustrated as being continuous lines, they may comprise or a series of dots, a plurality of spaced, linear segments or other arrangement without departing from the spirit of this application.

As best illustrated in FIG. 1A, each string of springs 30 has several groups of short pockets 58 of a first height $H_1$ and several groups of tall pockets 60 of a second height $H_2$ greater than the first height $H_1$. The height $H_2$ of each of the tall pockets 60 is preferably substantially identical and defined by the distance between the bottom surface 34 of the string of springs 30 and one of the longitudinal seams 56. On the other hand, the height $H_1$ of each of the short pockets 58 is preferably substantially identical and defined by the distance between the bottom surface 34 of the string of springs 30 and the longitudinal seam 54 which is inwardly spaced from the top surface 32 of the string of springs 30. Alternatively, the height $H_1$ of each of the short pockets 58 may be substantially identical and defined by the distance between two longitudinal seams 54 inwardly spaced from the top and bottom surfaces 32, 34 of the string of springs 30, such as is disclosed in applicant's U.S. patent application Ser. No. 10/307,883 filed Dec. 2, 2002 entitled "Pocketed Bedding or Seating Product Having Pockets of Alternating Heights".

In accordance with the present invention, all of the coil springs 38 within a string of springs 30 may be all the same height before being compressed and inserted into the pockets 36 of the strings of springs 30. Due to the difference in the heights of the short and tall pockets, 58, 60, respectively, the coil springs 38 located in the short pockets 58 are further compressed or loaded than are the coil springs 38 located in the tall pockets 60. For example, coil springs having an uncompressed height of eight inches might be compressed to a height of six inches in the tall pockets 60 and compressed to a height of four inches inside the short pockets 58.

Alternatively, the coil springs 38 inserted into the pockets 36 of the strings of springs 30 may be of different heights such that the coil springs are not compressed or just slightly compressed when the pockets 36 are closed. In this situation, the coil springs 38' inside the tall pockets 60 are higher than the coil springs 38" inside the short pockets 58 prior to being closed inside the pockets 58, 60, respectively. For purposes of this application, in either case, the coil springs 38' inside the tall pockets 60 of a second height, whether compressed or not, will be considered tall springs and the coil springs 38" inside the short pockets 58 of a first height, whether compressed or not, will be considered short springs.

Although one configuration of short coil spring and one configuration of tall coil spring are illustrated and described, the present invention may be utilized in accordance with many other different configurations of springs, including, but not limited to the following: springs with offsets therein to aid in joining together multiple springs, Bonnel type springs having knotted end turns, and modular springs.

Referring to FIG. 1A, along the longitudinal dimension of the bedding or seating product, the product 10 is divided into a plurality of sections of differing firmness so as to posturize the product. Moving from right to left in FIG. 1A, the product is divided into a head section 62, a shoulder section 64, an upper back section 66, a middle back section 68, a lower back section 70, a thigh section 72, and a foot section 74. The head, upper back, lower back and foot sections 62,66,70,74 are of a lesser firmness than the firmness of the shoulder, middle back and thigh sections 64,68,72, respectively. For purposes of this application, the shoulder, middle back and thigh sections, 64,68, and 72, each comprising rows of tall pockets 58, will be considered "firm" sections and the head, upper back, lower back and foot sections 62,66,70, and 74, each comprising rows of short pockets 60 and filler 14, will be considered "soft" sections. Although FIGS. 1 and 1A illustrate four soft sections and three firm sections, any number of firm sections of any size and any number of soft sections of any size may be incorporated into the product of the present invention, depending upon the desired application. Similarly, the location of the different sections may be varied depending upon the firmness effect desired.

In this preferred embodiment, each of the pocketed coil springs within a particular section is identical and of the same height. As illustrated in FIGS. 1 and 1A, the short coil springs 38" of the head, upper back, lower back and foot sections 62, 66, 70, and 74 are of a first height $H_1$. The tall coil springs 38' of the shoulder, middle back and thigh sections 64, 68, and 72 are of a second height $H_2$, greater than the first height $H_1$ and approximately equal to the height H of the product 10 As best seen in FIG. 1A, the tall coil springs 38' extend above the upper end turns 40 of the short coil springs 38" within the pocketed spring assembly 12.

As best illustrated in FIGS. 1 and 1A, pieces of filler 14 are located in the head, upper back, lower back and foot sections 62, 66, 70, and 74, respectively above the short pockets 58. The filler 14 rests on top of the upper surfaces 59 of the short pockets 58. Each of the pieces of filler 14 has an upper surface 76 and a lower surface 78. As shown in FIG. 1A, the distance between the upper and lower surfaces 76,78 defines a third height $H_3$ such that the sum of the first height $H_1$ (the height of the short pockets) and the third height $H_3$ (the height of the pieces of filler 14) equals the second height $H_2$ (the height of the tall pockets). As best illustrated in FIG. 1A, the upper end turns 40 of the tall coil springs 38' are generally coplanar in a horizontal plane $P_1$ with the upper surfaces 76 of the pieces of filler 14, thus creating a relatively uniform upper surface 20 of the product. As is conventional, an upholstered covering 18 surrounds the insulator pad 16, the pieces of filler 14 and the pocketed spring assembly 12.

Figure 2A:
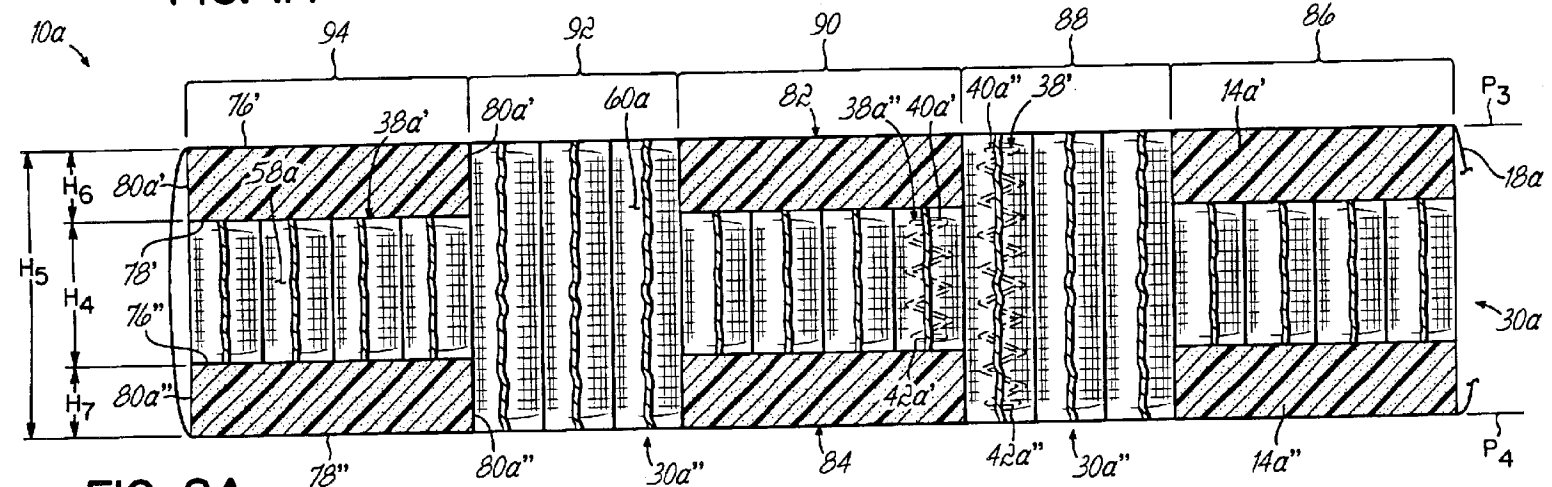
FIG. 2A is a cross-sectional view taken along the line 2A—2A of FIG. 2.
Figure 2:
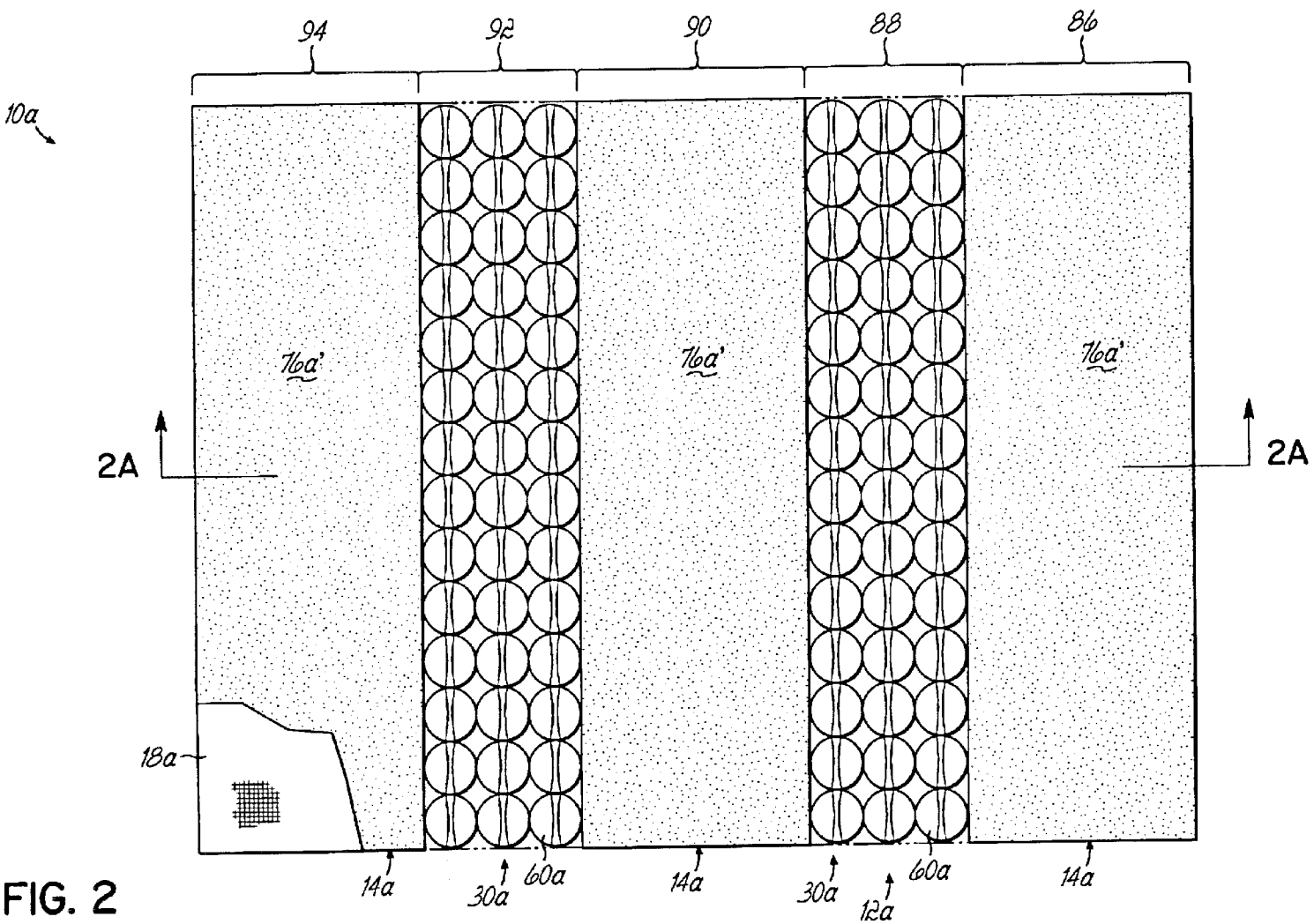
FIG. 2 is a top view of an alternative preferred embodiment of the present invention.

FIGS. 2 and 2A illustrate an alternative embodiment of bedding or seating product 10*a*. This embodiment of product 10*a* has a pocketed spring assembly 12*a* made up of a plurality of transversely extending strings of springs 30*a* joined together. In this embodiment, unlike the embodiment shown in FIGS. 1 and 1A, each string of springs 30*a* has pockets of the same height along its entire length. As illustrated in FIG. 2A, the pocketed spring assembly 12*a* comprises a plurality of groups of parallel, transversely extending short strings of springs 30*a'* and a plurality of groups of parallel, transversely extending tall strings of springs 30*a"*. Each of the short strings of springs 30*a'* comprises a plurality of interconnected short pockets 58*a* each containing at least one short coil spring 38*a'*. The short pockets 58*a* are of a fixed height $H_4$ defined between an upper end turn 40*a'* and a lower end turn 42*a'* of the short coil spring 38*a'*. Similarly, each of the tall strings of springs 30*a"* comprises a plurality of interconnected tall pockets 60*a* each containing at least one tall coil spring 38*a"*. The tall pockets 60*a* are of a fixed height $H_5$ greater than the height $H_4$ of the short coil springs 58*a'* and defined between an upper end turn 40*a"* and a lower end turn 42*a"* of the tall coil spring 38*a"*.

The tall pockets 60*a* extend both above the upper end turns 40*a'* of the short coil springs 38*a'*, a distance $H_6$ and below the lower end turns 42*a"* of the short coil springs 38*a'*, a distance $H_7$. Although distances $H_6$ and $H_7$ are illustrated as being approximately equal, they may differ.

Pieces of filler 14*a'* are located above the upper surfaces of the short pockets 58*a*. Each of the pieces of filler 14*a'* has an upper surface 76*a'*, a lower surface 78*a"* and side surfaces 80*a'*. The distance between the upper and lower surfaces 76*a'*,78*a'* defines a height $H_6$ so that when resting on the upper surfaces of the short pockets 58*a*, the upper surfaces 76*a'* of the pieces of filler 14*a'* are generally coplanar with the upper surfaces of the tall pockets 60. The upper surfaces 76*a'* of the pieces of filler 14*a'* and the upper surfaces of the tall pockets 60 create a generally uniform upper surface 82 located in a top plane $P_3$ (see FIG. 2A).

Similarly, below each of the short coil pockets 58*a* is a piece of filler 14*a"* having an upper surface 76*a"*, a lower surface 78" and side surfaces 80*a"*. The vertical distance between the upper and lower surfaces 76*a"*,78*a"* defines the thickness or height $H_7$ of each piece of filler 14*a"*. As best illustrated in FIG. 2A, the lower surfaces of the short pockets 58*a* rest upon the upper surface 76*a"* of the pieces of filler 14*a"*. The lower surfaces 78*a"* of the pieces of filler 14*a"* are generally coplanar with the lower surfaces of the tall pockets 60*a*, defining a lower surface 84 of the product 10*a* in a generally horizontal plane $P_4$. An upholstered covering 18*a* surrounds the pieces of filler 14*a'*, 14*a"* and the pocketed spring assembly 12*a*.

The bedding or seating product 10*a* is divided into sections of differing firmness. Moving from right to left as illustrated in FIGS. 2 and 2A, the product 10*a* is divided into a head section 86, an upper back section 88, a middle back section 90, a lower back section 92, and a foot section 94. The head, middle back and foot sections 86,90 and 94 each comprise two pieces of filler 14*a'*,14*a"* and a plurality of rows of short pockets 58*a* of a height $H_4$. The upper and lower back sections 88,92 each comprise a plurality of rows of tall pockets 60 of a height $H_5$. The firmness of the upper and lower back sections 88,92 are greater than the firmness of the head, middle back, and foot sections 86,90, and 94 due at least in part to the pocketed springs in those sections being taller than the pocketed springs in the head, middle, back and foot sections.

Figure 3:
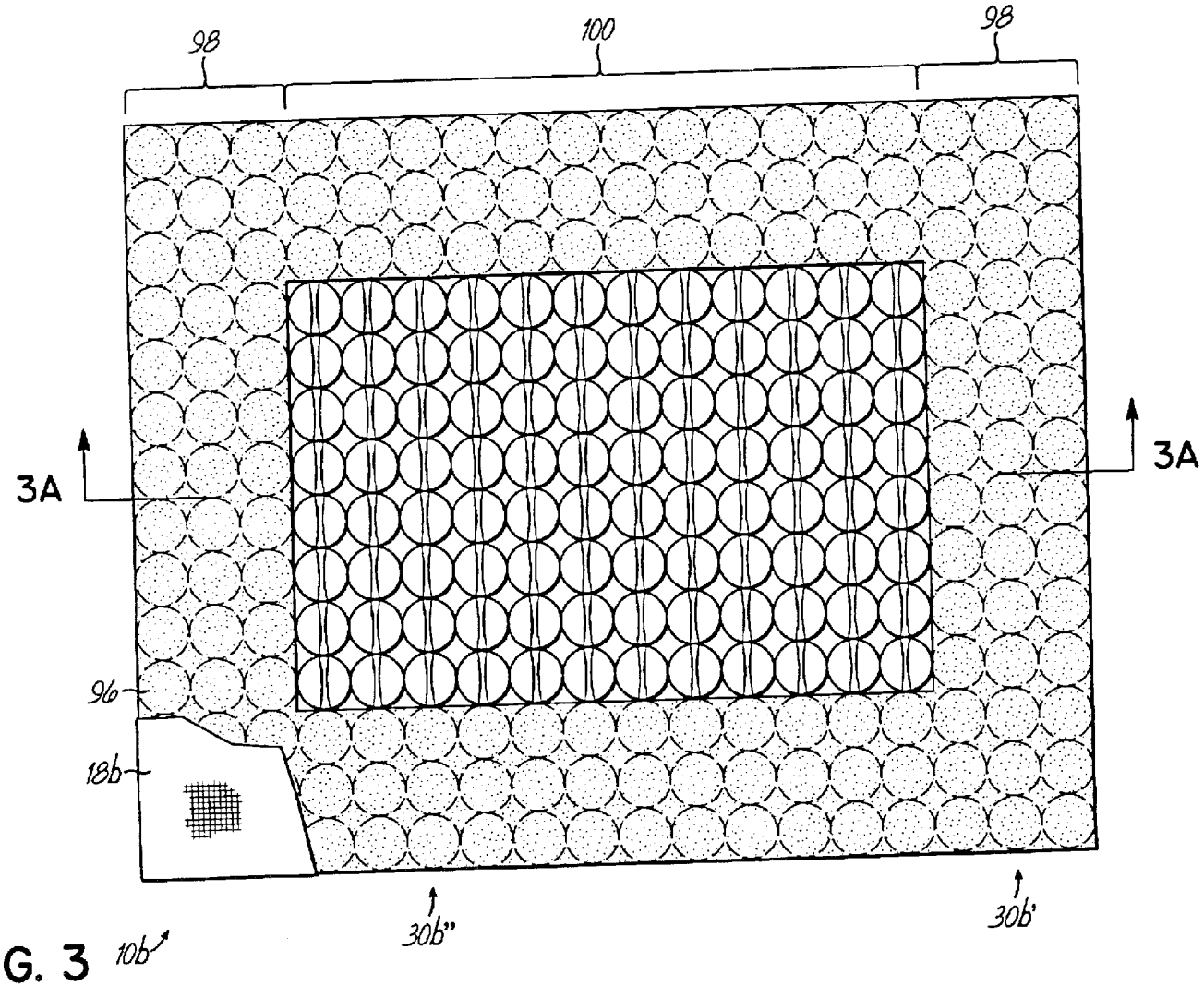
FIG. 3 is a top view of another preferred embodiment of the bedding or seating product made in accordance with the present invention.
Figure 3A:
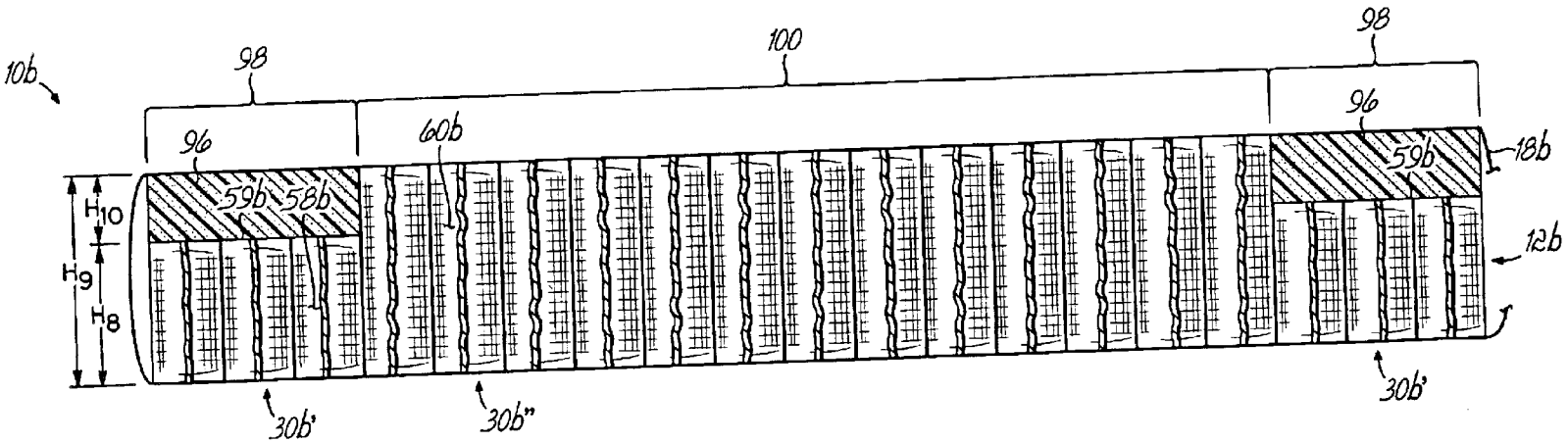
FIG. 3A is a cross-sectional view taken along the line 3A—3A of FIG. 3.

FIGS. 3 and 3A illustrate an alternative preferred embodiment of the present invention. As illustrated in FIG. 3A, a bedding or seating product 10*b* comprises a pocketed spring assembly 12*b* made up of a plurality of transversely extending strings of springs 30*b*' and 30*b*" joined to each other. Three transversely extending strings of springs 30*b*' on each end of the pocketed spring assembly 12*b* are joined to a plurality of transversely extending strings of springs 30*b*" therebetween. Although three transversely extending strings of springs 30*b*' are illustrated as being on each end, any number of transversely extending strings of springs 30*b*' may be used. As illustrated in FIGS. 3 and 3A, each string of springs 30*b*' comprises a plurality of interconnected short pockets 58*b* of a first height $H_8$. As illustrated in FIGS. 3 and 3A, each string of springs 30*b*" comprises a plurality of short pockets 58*b* of a first height $H_8$ at the end of the string of springs 30*b*" and multiple tall pockets 60*b* of a second height $H_9$ greater than the first height $H_8$ between the groups of short pockets 58*b*. One or more pieces of filler 96 of a third height $H_{10}$ is located in an edge support section or region 98 above the upper surfaces 59*b* of the short pockets 58*b* around the perimeter of the product. A generally rectangular cental section 100 of tall pockets 60*b* creates a central core of increased firmness relative to the firmness of the edge section or perimeter section 98 of the product. The edge support section 98 and central section 100 of the product 10*b* may be any thickness or size desired. Although not illustrated, the embodiment illustrated in FIGS. 3 and 3A may have filler located underneath the short pockets 58*b*, the tall pockets 60*b* extending below the lower surfaces of the short pockets 58*b* as illustrated in FIGS. 2 and 2A. A fabric cover 18*b* encases the piece or pieces of filler 96 and pocketed spring assembly 12*b*.

Figure 4A:
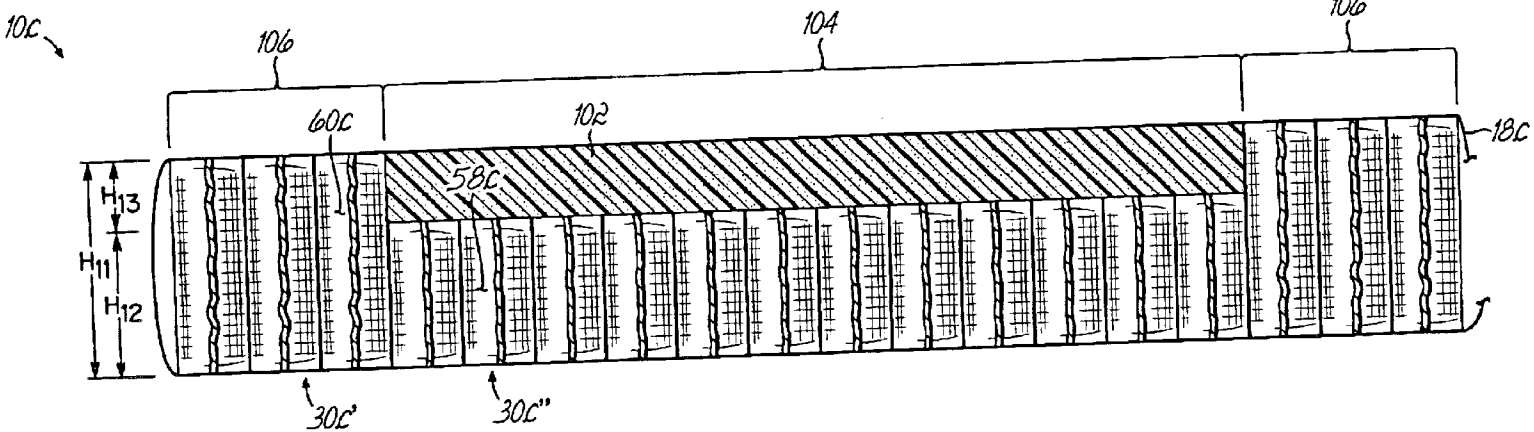
FIG. 4A is a cross-sectional view taken along the line 4A—4A of FIG.4.
Figure 4:
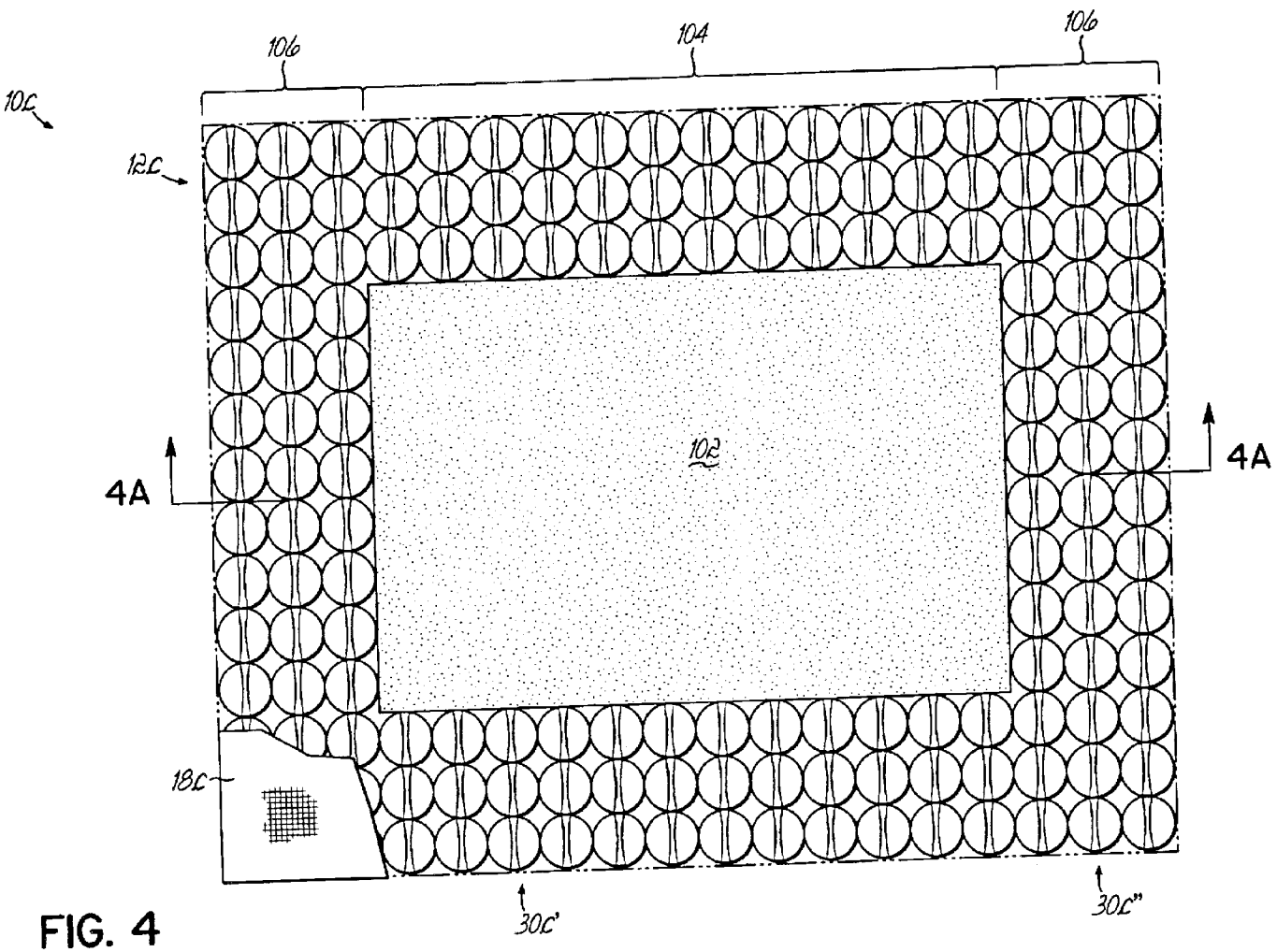
FIG. 4 is a top view of another preferred embodiment of the present invention.

FIGS. 4 and 4A illustrate an alternative preferred embodiment of the present invention 10*c*. As illustrated in FIG. 4A, the product 10*c* comprises a pocketed spring assembly 12*c* comprises a pocketed spring assembly 12*c* made up of a plurality of transversely extending strings of springs 30*c*' and 30*c*" joined to each other. Three transversely extending strings of springs 30*c*' on each end of the pocketed spring assembly 12*c* are joined to a plurality of transversely extending strings of springs 30*c*" therebetween. Although three transversely extending strings of springs 30*c*' are illustrated as being on each end, any number of transversely extending strings of springs 30*c*' may be used. As illustrated in FIGS. 4 and 4A, each string of springs 30*c*' comprises a plurality of interconnected tall pockets 60*c* of a height $H_{11}$. As illustrated in FIGS. 4 and 4A, each string of springs 30*c*" comprises a plurality of tall pockets 60*c* of a height $H_{11}$ at the end of the string of springs 30*b*" and multiple short pockets 58*c* of a height $H_{12}$ less than the height $H_{11}$ between the groups of tall pockets 60*c*. One or more pieces of filler 102 of a height $H_{13}$ is/are located above the short pockets 58*c* in a generally rectangular central section 104 of the product. Tall pockets 60*c* are arranged in an edge support section 106 around the perimeter of the central section 104 of the product. The tall pockets 60*c* are of an increased firmness relative to the firmness of the central section 104 of the product. Therefore, the tall pockets 60*c* provide edge support around the perimeter of the product of increased firmness. The edge support section 106 and central section 104 of the product may be any thickness or size desired. Although not illustrated, the embodiment illustrated in FIGS. 4 and 4A may have filler located underneath the short pockets 58*c*, the tall pockets 60*c* extending below the lower end turns of the short pockets 58*c* as illustrated in FIGS. 2 and 2A. Covering material including an upholstered covering 18*c* encases the piece or pieces of filler 102 and pocketed spring assembly 12*c*.

Figure 5:
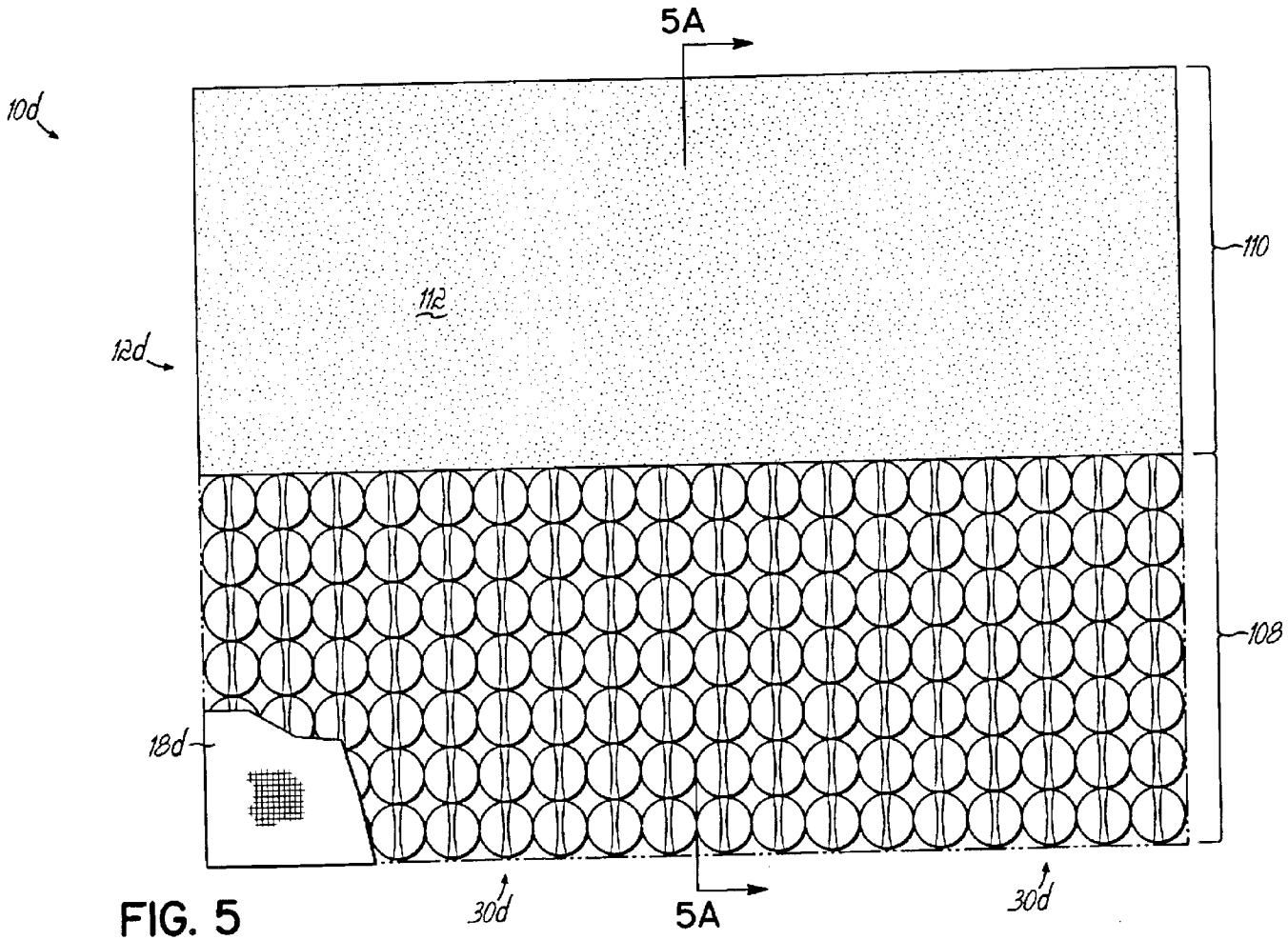
FIG. 5 is a top view of another preferred embodiment of the present invention.
Figure 5A:
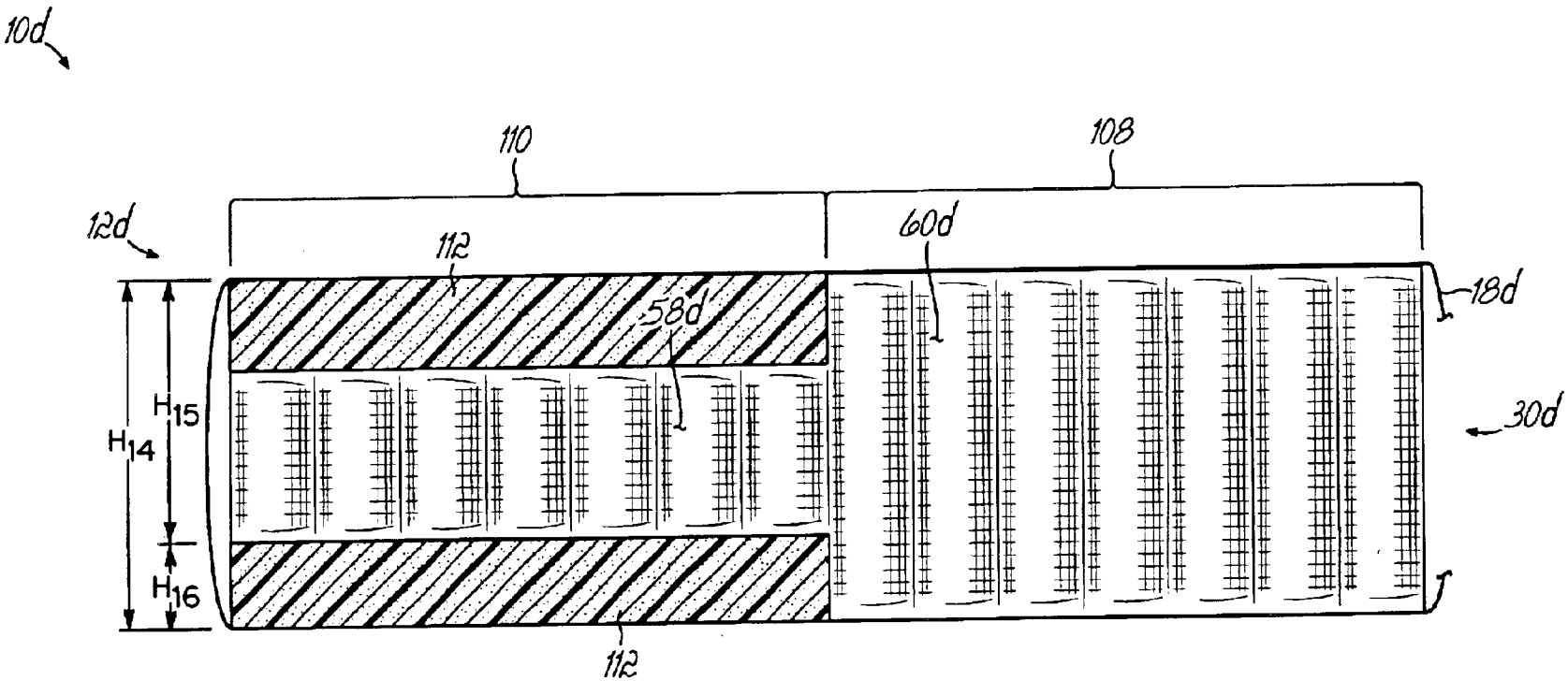
FIG. 5A is a cross-sectional view taken along the line 5A—5A of FIG. 5.

FIGS. 5 and 5A illustrate an alternative preferred embodiment of the present invention in which the sections of the product extend longitudinally. Referring to FIG. 5, there is illustrated a product 10*d* having two sections of differing firmness, a firm section 108 and a soft section 110. Referring to FIG. 5A, the product 10*d* comprises a pocketed spring assembly 12*d* and pieces of filler 112 surrounded in an upholstered covering 18*d*. The pocketed spring assembly 12*d* comprises a plurality of transversely extending strings of springs 30*d* joined together. As seen in FIG. 5A, each string of springs 30*d* comprises a group or series of tall pockets 60*d* of a height $H_{14}$ and a group or series of short pockets 58*d* of a height $H_{15}$. At least one piece of filler 112 of a height $H_{16}$ rests on top of the upper surfaces of the short pockets 58*d*. Similarly, at least one piece of filler 112 of a height $H_{16}$ rests below the lower surfaces of the short pockets 58*d*. The firm section 108 comprises a plurality of tall pockets 60*d* and the soft section 110 comprises a plurality of short pockets 58*d*, along with pieces of filler 112. If a one-sided product is desired, the soft section 110 may comprise short coil pockets 58*d* and filler located only above the short pockets 58*d*. In this embodiment, although the strings of springs 30*d* are illustrated as extending transversely, they may extend longitudinally.

Figure 6:
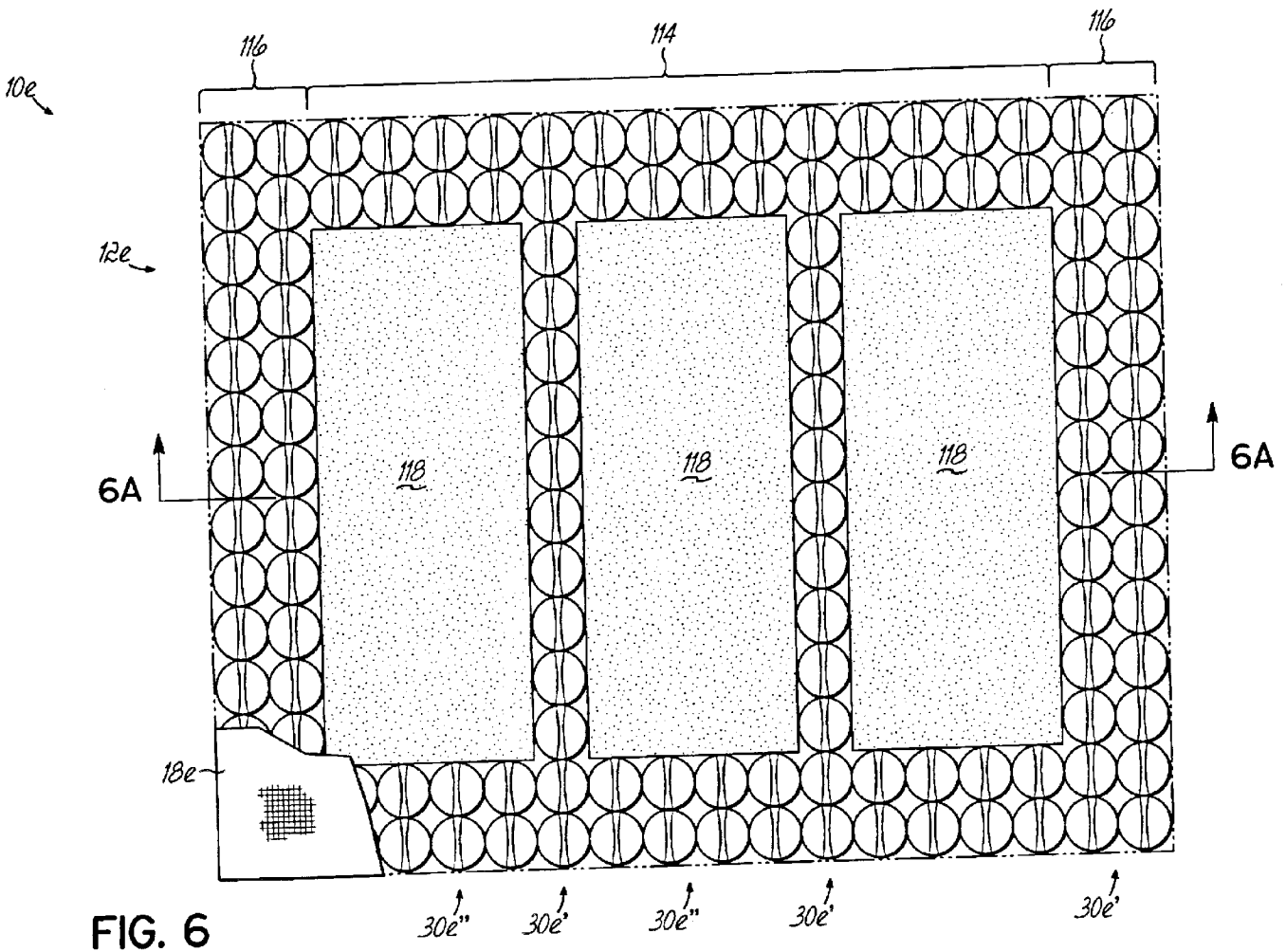
FIG. 6 is a top view of another preferred embodiment of the present invention.
Figure 6A:
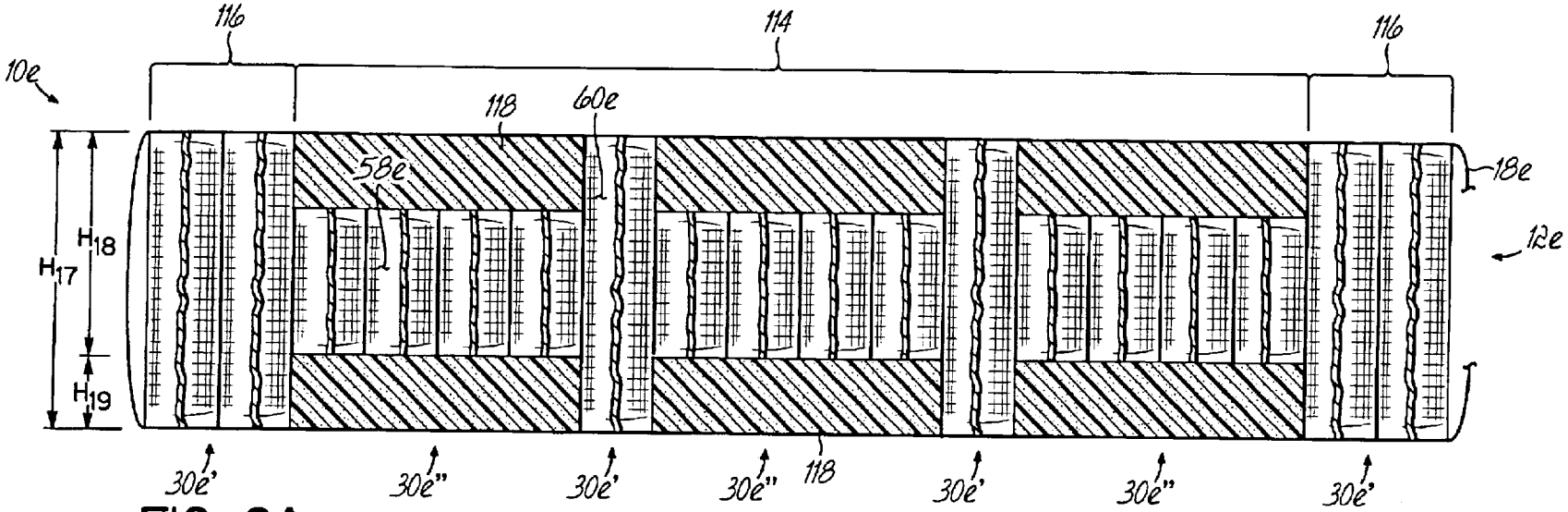
FIG. 6A is a cross-sectional view taken along the line 6A—6A of FIG. 6.

FIGS. 6 and 6A illustrate an alternative preferred embodiment of the present invention 10*e*. As illustrated in FIG. 6, the product 10*e* comprises a pocketed spring assembly 12*e* made up of a plurality of transversely extending strings of springs 30*e*' and 30*e*" joined to each other. The pocketed spring assembly 12*e* has a central section 114 and an edge support section 116 around the perimeter of the central section 114. Two transversely extending strings of springs 30*e*' are located on each end of the pocketed spring assembly 12*e* and comprise part of the edge support section 116. Although two transversely extending strings of springs 30*e*' are illustrated as being on each end, any number of transversely extending strings of springs 30*e*' may be used. As illustrated in FIGS. 6 and 6A, each string of springs 30*e*' comprises a plurality of interconnected tall pockets 60*e* of a height $H_{17}$. As illustrated in FIGS. 6 and 6A, each string of springs 30*e*" comprises a pair of tall pockets 60*e* of a height $H_{17}$ at the end of the string of springs 30*e*" and multiple short pockets 58*e* of a height $H_{18}$ less than the height H16 between the tall pockets 60*e*. Pieces of filler 118 of a height $H_{19}$ are located above the short pockets 58*e* in the central section 114 of the product. Tall pockets 60*e* are arranged in an edge support section 116 around the perimeter of the central section 114 of the product. The tall pockets 60*e* are of an increased firmness relative to the firmness of the central section 114 of the product. Therefore, the tall pockets 60*e* provide edge support around the perimeter of the product of increased firmness. The edge support section 116 and central section 114 of the product may be any thickness or size desired. Although not illustrated, the embodiment illustrated in FIGS. 6 and 6A may have filler located only above the short pockets 58*e*. Covering material including an upholstered covering 18*c* encases the pieces of filler 118 and pocketed spring assembly 12*e*. In this embodiment, although the strings of springs 30*d* are illustrated as extending transversely, they may extend longitudinally.

Figure 6B:
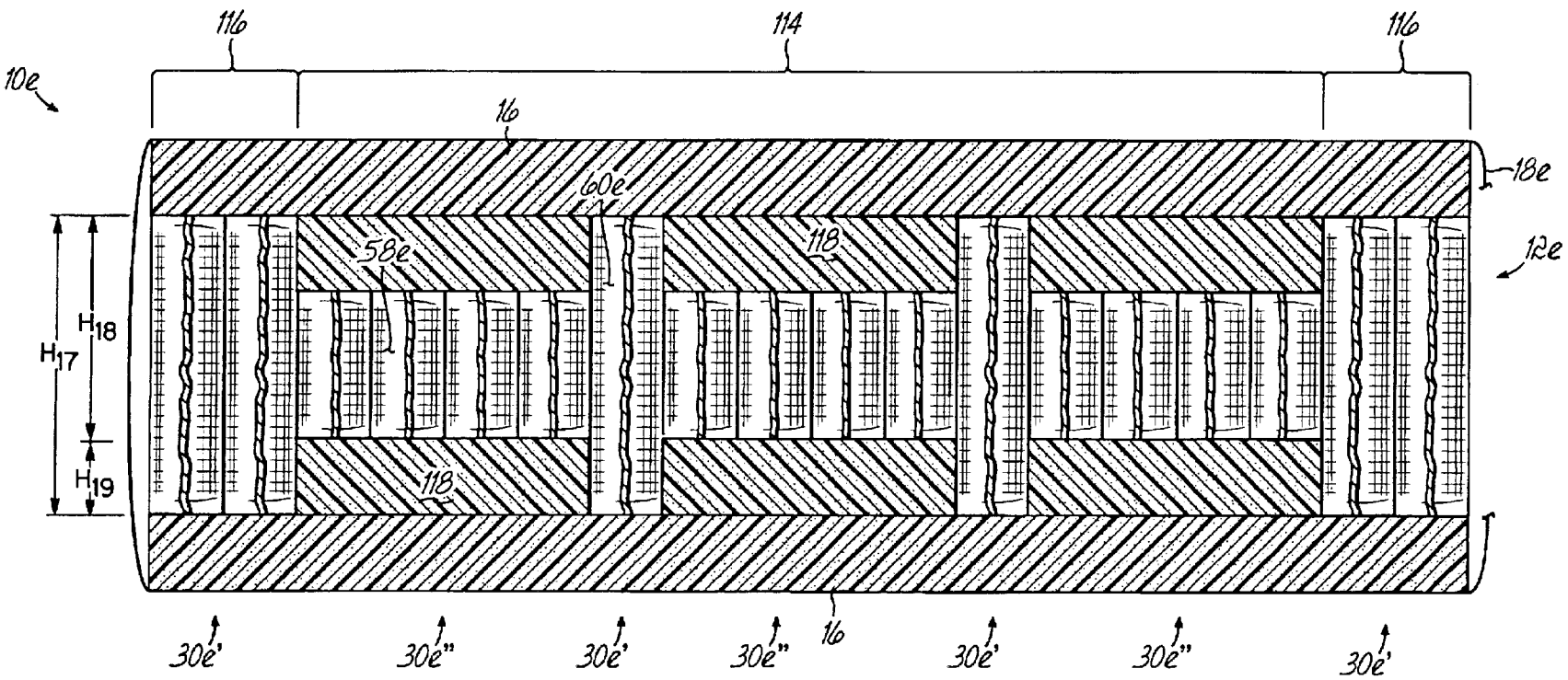
FIG. 6B is a cross-sectional view taken of the product shown in FIG. 6 with padding materials added.

FIG. 6B illustrates the embodiment of FIGS. 6 and 6A but with padding 16 located above and below the pocketed spring assembly 12*e* and pieces of filler 118. The fabric covering 18*e* encases the pocketed spring assembly 12*e*, pieces of filler 118 and padding 18.

While we have described several preferred embodiments of the present invention, those skilled in the art will appreciate changes and modifications which can be made to the present invention without departing from the scope of the present invention. For example, springs other than individual coil springs, such as for example bands of coil springs may be incorporated into the pocketed spring assembly of any of the embodiments of the present invention. Therefore, we intend to be limited only be the scope of the following claims.

We claim:

1. A bedding or seating product comprising:

a pocketed spring assembly comprising a plurality of parallel strings of springs joined together, each of said strings of springs comprising a plurality of interconnected pocketed coil springs, each of said pocketed coil springs comprising a coil spring surrounded by a pocket of fabric, wherein within at least some of said strings of springs selected ones of said pockets of fabric are shorter than the other pockets of fabric;

filler located above only said selected ones of said pockets of fabric; and an upholstered covering surrounding said pocketed spring assembly and said filler.

2. A bedding or seating product comprising:

a pocketed spring assembly comprising a plurality of parallel strings of springs joined together, each of said strings of springs comprising a plurality of interconnected pocketed coil springs, each of said pocketed coil springs comprising a coil spring surrounded by a pocket of fabric, wherein within at least some of said strings of springs selected ones of said pockets of fabric are shorter than the other pockets of fabric; and filler located above only said selected ones of said pockets of fabric.

3. The bedding or seating product of claim 2 wherein said filler comprises urethane foam.

4. The bedding or seating product of claim 2 wherein all of said coil springs are identical prior to being pocketed.

5. The bedding or seating product of claim 2 wherein said product has a longitudinal dimension and a transverse dimension, said longitudinal dimension being greater than said transverse dimension, said strings of springs extending longitudinally.

6. The bedding or seating product of claim 2 wherein at least one border wire is secured to said pocketed spring assembly.

7. The bedding or seating product of claim 2 wherein adjacent strings of springs are glued together.

8. A bedding or seating product comprising:

a pocketed spring assembly comprising a plurality of parallel strings of springs joined to each other, each of said strings of springs comprising a plurality of interconnected pocketed springs, each of said pocketed springs comprising a spring surrounded by a pocket of fabric, wherein said pocketed spring assembly has multiple regions of differing firmness, at least one of said regions having pockets of a first height and at least one of said regions having pockets of a second height, said second height being greater than said first height; and filler located above said pockets of a first height, said filler having a third height such that the sum of the first and third heights equals the second height.

9. The product of claim 8 wherein each of said springs is a coil spring having upper and lower end turns and a plurality of central convolutions between said end turns.

10. The product of claim 8 wherein said product has a longitudinal dimension and a transverse dimension, said longitudinal dimension being greater than said transverse dimension, said strings of springs extending longitudinally.

11. The product of claim 8 wherein said product has a longitudinal dimension and a transverse dimension, said longitudinal dimension being greater than said transverse dimension, said strings of springs extending transversely.

12. The product of claim 8 further comprising at least one border wire surrounding said pocketed spring assembly.

13. A bedding or seating product having a longitudinal dimension and a transverse dimension, said longitudinal dimension being greater than said transverse dimension, said product comprising:

a pocketed spring assembly comprising a plurality of parallel strings of springs joined to each other and extending in a transverse direction, each of said strings of springs comprising a plurality of interconnected pocketed springs, each of said pocketed springs comprising a coil spring surrounded by a pocket of fabric, said coil spring having an upper end turn, a lower end turn and a plurality of central convolutions between said end turns;

wherein said pocketed spring assembly has multiple regions of differing firmness, at least one of said regions having strings of springs in which the pockets of the strings of springs are of a first height and at least one of said regions having strings of springs in which the pockets of the strings of springs are of a second height, said second height being greater than said first height; and filler located above said strings of springs in which the pockets are of a first height, said filler having an upper surface substantially coplanar with the upper end turns of said coil springs within said pockets of a second height.

14. The bedding or seating product of claim 13 wherein said filler comprises urethane foam.

15. A bedding or seating product comprising:

a pocketed spring assembly comprising a plurality of parallel strings of springs joined together, each of said strings of springs comprising a plurality of interconnected pocketed springs, each of said pocketed springs comprising a spring surrounded by a pocket of fabric, wherein within said pocketed spring assembly some of said strings of springs have pockets of differing heights, said pocketed spring assembly having a central section and an edge support section surrounding said central section, said edge section comprising pockets taller than at least some of said pockets of said central section; and filler located above at least a portion of said central section.

16. A method of manufacturing a bedding or seating product having a pocketed spring assembly, said method comprising:

inserting a spring into each pocket of a string of springs;

closing all of said pockets of said string of springs such that fabric encases the spring in each of said pockets, selected pockets within said string of springs being of a height less than the other pockets in said string of springs;

joining said string of springs to adjacent strings of springs to form a pocketed spring assembly;

placing filler above said selected pockets of said pocketed spring assembly; and encasing said pocketed spring assembly and filler in a fabric covering.

17. A method of manufacturing a bedding or seating product comprising a pocketed spring assembly made of a plurality of strings of springs joined to each other, each of said string of springs comprising a piece of fabric folded such that said piece of fabric has opposed plies on opposite sides of a row of springs, said opposed plies being joined together between adjacent springs in said string of springs, said method comprising:

inserting at least one spring into each pocket of a short string of springs, closing all of said pockets of said short string of springs such that fabric encases said at least one spring in each of said pockets, wherein every pocket within said short string of springs is a first height;

joining multiple short strings of springs together to form a group of short strings of springs;

inserting at least one spring into each pocket of a tall string of springs, closing all of said pockets of said tall string of springs such that fabric encases said at least one spring in each of said pockets, wherein every pocket within said tall string of springs is a second height greater than said first height;

joining multiple tall strings of springs together to form a group of tall strings of springs;

joining said group of tall strings of springs to said group of short strings of springs to form a pocketed spring assembly;

placing filler above said short strings of springs of said pocketed spring assembly; and encasing said pocketed spring assembly and filler in a fabric covering.

18. A method of manufacturing a bedding or seating product having a pocketed spring assembly, said method comprising:

forming strings of springs having pockets of differing heights;

forming strings of springs having pockets of the same height;

joining said string of springs having pockets of differing heights to strings of springs having pockets of the same height to form a pocketed spring assembly;

placing filler above selected pockets of said pocketed spring assembly; and encasing said pocketed spring assembly and filler in a fabric covering.

19. The method of claim 18 wherein forming said strings of springs having pockets of differing heights includes inserting a spring into each pocket of a string of springs;

closing all of said pockets of said string of springs such that fabric encases the spring in each of said pockets, selected pockets within said string of springs being of a height less than the other pockets in said string of springs.

20. The method of claim 18 wherein forming said strings of springs having pockets of the same height includes:

inserting a spring into each pocket of a string of springs having pockets of the same height;

closing all of said pockets of said string of springs having pockets of the same height such that fabric encases the spring in each of said pockets, all said pocket of said string of springs having pockets of the same height.

* * * * *

UNITED STATES PATENT AND TRADEMARK OFFICE

CERTIFICATE OF CORRECTION

PATENT NO. : 6,813,791 B2 
DATED : November 9, 2004
INVENTOR(S) : Niels S. Mossbeck and Thomas J. Wells It is certified that error appears in the above-identified patent and that said Letters Patent is hereby corrected as shown below:

Column 4,
Line 8, change “Applicant’s” to -- Applicants’ --.
Line 22, change “strings springs” to -- strings of springs --.
Line 31, change “are” to -- is --.

Column 5,
Line 47, after “seating product”, insert -- 10 --.

Column 6,
Line 13, change “H2” to -- $H_2$ --.
Line 32, delete the first occurrence of “or”.
Line 51, change “applicant’s” to -- applicants’ --.

Column 7,
Line 49, after “10”, insert a period (.).

Column 8,
Line 66, change “are” to -- is --.

Column 9,
Line 40, delete “comprises a pocketed spring assembly 12c”.

Column 10,
Line 48, change “H16” to -- $H_{16}$ --.

Column 11,
Line 12, change “be” to -- by --.

UNITED STATES PATENT AND TRADEMARK OFFICE

CERTIFICATE OF CORRECTION

PATENT NO. : 6,813,791 B2
DATED : November 9, 2004
INVENTOR(S) : Niels S. Mossbeck and Thomas J. Wells It is certified that error appears in the above-identified patent and that said Letters Patent is hereby corrected as shown below:

Column 14,
Line 31, change "all said pocket" to -- all of said pockets --.

Signed and Sealed this

Seventh Day of June, 2005

JON W. DUDAS
*Director of the United States Patent and Trademark Office*